US008876002B2

(12) United States Patent
Arnao et al.

(10) Patent No.: US 8,876,002 B2
(45) Date of Patent: Nov. 4, 2014

(54) SYSTEMS FOR CONFIGURING VOTING MACHINES, DOCKING DEVICE FOR VOTING MACHINES, WAREHOUSE SUPPORT AND ASSET TRACKING OF VOTING MACHINES

(75) Inventors: Federico Arnao, Oakland, CA (US); Eric Coomer, Oakland, CA (US); Larry Korb, Oakland, CA (US); Josh Maletz, Oakland, CA (US)

(73) Assignee: Dominion Voting Systems, Inc., Denver, CO (US)

( * ) Notice: Subject to any disclaimer, the term of this patent is extended or adjusted under 35 U.S.C. 154(b) by 0 days.

(21) Appl. No.: 13/092,604

(22) Filed: Apr. 22, 2011

(65) Prior Publication Data

US 2012/0048930 A1 Mar. 1, 2012

Related U.S. Application Data

(63) Continuation of application No. PCT/US2009/062069, filed on Oct. 26, 2009.

(60) Provisional application No. 61/193,062, filed on Oct. 24, 2008.

(51) Int. Cl.
*G07C 13/00* (2006.01)

(52) U.S. Cl.
CPC ..... *G07C 13/00* (2013.01)
USPC ..... 235/386; 235/51; 235/54 F

(58) Field of Classification Search
USPC ..... 235/51, 52, 54 E, 54 F, 56, 57, 386, 454, 235/462.01, 487, 492
See application file for complete search history.

(56) References Cited

U.S. PATENT DOCUMENTS

| | | | | |
|---|---|---|---|---|
| 4,510,378 | A * | 4/1985 | Dolson | 235/50 R |
| 4,641,240 | A * | 2/1987 | Boram | 705/12 |
| 4,649,264 | A * | 3/1987 | Carson | 235/54 R |
| 5,065,832 | A * | 11/1991 | Mark | 108/60 |
| 5,666,765 | A * | 9/1997 | Sarner et al. | 52/36.1 |
| 5,897,180 | A * | 4/1999 | Singer | 312/265.3 |
| 6,173,352 | B1 * | 1/2001 | Moon | 710/301 |
| 6,250,548 | B1 * | 6/2001 | McClure et al. | 235/51 |
| 6,581,824 | B1 * | 6/2003 | McClure et al. | 235/51 |
| 6,641,033 | B2 * | 11/2003 | McClure et al. | 235/51 |
| 6,662,998 | B2 * | 12/2003 | McClure et al. | 235/51 |
| 6,688,517 | B1 * | 2/2004 | McClure et al. | 235/51 |
| 6,799,723 | B2 * | 10/2004 | Kotob et al. | 235/386 |
| 6,827,262 | B2 * | 12/2004 | McClure et al. | 235/386 |
| 6,951,303 | B2 * | 10/2005 | Petersen et al. | 235/386 |
| 6,973,581 | B2 * | 12/2005 | Chung et al. | 726/13 |
| 7,111,782 | B2 * | 9/2006 | Homewood et al. | 235/386 |

(Continued)

*Primary Examiner* — Paultep Savusdiphol
(74) *Attorney, Agent, or Firm* — Holland & Hart LLP

(57) ABSTRACT

A system and device facilitate the storage and tracking of warehoused voting machines. A system includes a host computer, a plurality of voting machines that are connected via a network to the host computer, each voting machine having one or both of a wireless communication device and a data port that is coupled to the host computer. The system also includes an election and voting machine preparation portion included in the host computer to manage and/or control the connected voting machines. The election and voting machine preparation portion is configured to manage the status of the connected voting machines, is configured to instruct the voting machines to run self tests, is configured to receive results of the self tests back from the connected voting machines, and is configured to prepare/program the connected voting machines with an election ballot.

17 Claims, 8 Drawing Sheets

(56) References Cited

U.S. PATENT DOCUMENTS

| | | | | |
|---|---|---|---|---|
| 7,392,993 | B1 * | 7/2008 | Prohl et al. | 280/33.998 |
| D578,564 | S * | 10/2008 | Bolton | D18/6 |
| 2001/0013547 | A1 * | 8/2001 | Kotob et al. | 235/386 |
| 2001/0042005 | A1 * | 11/2001 | McClure et al. | 705/12 |
| 2002/0185395 | A1 * | 12/2002 | Lindamood | 206/320 |
| 2003/0047604 | A1 * | 3/2003 | McClure et al. | 235/386 |
| 2003/0047605 | A1 * | 3/2003 | McClure et al. | 235/386 |
| 2003/0066872 | A1 * | 4/2003 | McClure et al. | 235/51 |
| 2004/0169077 | A1 * | 9/2004 | Petersen et al. | 235/386 |
| 2006/0138226 | A1 * | 6/2006 | McClure et al. | 235/386 |
| 2008/0224582 | A1 * | 9/2008 | Boland | 312/330.1 |

* cited by examiner

SYSTEMS FOR CONFIGURING VOTING MACHINES, DOCKING DEVICE FOR VOTING MACHINES, WAREHOUSE SUPPORT AND ASSET TRACKING OF VOTING MACHINES

This application is a continuation of International Application No. PCT/US2009/062069, filed Oct. 26, 2009, which claims the benefit of U.S. Provisional Application No. 61/193,062, filed Oct. 24, 2008, each of which are incorporated herein by reference in their entirety.

BACKGROUND

The warehousing processes associated with an election are some of the most problematic and time consuming in the entire election process, especially for larger jurisdictions. The complexity of these processes increases exponentially with the size of the jurisdiction.

Electronic voting systems consist of several disparate systems including the Election Management System (EMS), Ballot Tabulators (digital-optical scan voting machines, direct-record-electronic (DRE) voting machines, etc), as well as other ancillary systems including electronic poll-books, accumulation and consolidation devices, and wireless transmission systems for results. Managing these assets can be a significant burden to jurisdictions. In addition, current voting systems rely on a disconnected process for programming the voting machines to transfer the ballot definition data from the EMS to the voting machines. This is historically accomplished by writing the ballot definition data to a removable memory element from the EMS-flash drive usb drives, secure-digital flash drives, PCMCIA flash drives etc. This disconnected process introduces several failure points in the process, and significantly increases the overall effort required of jurisdictions to run an election.

Further, due to the periodic nature of elections, voting machines are necessarily stored for periods up to years in between elections. Therefore, it is desirable to produce apparatus for and methods of adequately, safely and efficiently storing voting machines in between elections.

Furthermore, in large jurisdictions having several voting machines, it is desirable to provide a means for tracking the voting machines as they are used in an election.

SUMMARY

In view of the above issues, a number of improvements are presented.

The system for configuring voting machines described herein has the following benefits. First, the system significantly reduces the effort required to test the functioning of the voting machine by automating the programming and testing of the machines. Second, the system significantly reduces the effort required to prepare and conduct pre-election Logic and Accuracy Tests (pre-LAT) on the voting machines, by automating as much of the process as possible in the warehouse. Third, this system allows warehouse workers to identify and locate voting machines that have faults. Fourth, this system allows warehouse workers to identify and locate voting machines that failed to prepare correctly. Fifth, this system allows warehouse workers to identify and locate voting machines that failed pre-LAT. And sixth, this system ensures voting machine integrity by ensuring that network functionality is not available after pre-LAT has been completed.

Some improvements allow for the safe stacking and storage of voting machines in a warehouse, allow voting machines to be provided with power to operate and charge batteries while being stored in the warehouse, allow voting machines to be connected to a network while being stored in the warehouse, and allow the location of individual voting machines to be tracked while being stored in the warehouse.

Another improvement relates to a storage and docking station designed for each type of voting machine and allows voting machines to be stacked and stored safely such that the voting machines are protected from damage. The storage and docking station also is capable of providing power to the machines for battery charging and network connectivity, if supported, for connection to a warehouse management application. The docking station also provides security authentication, which will allow the voting machine to activate various interface ports and support various modes of operation.

The protective docking device can accept a voting machine such that the protective docking device provides physical protection for the voting machine while being stored. Additionally, the protective docking device is capable of being stacked on other protective docking devices such that no damage occurs to the voting machines while being stored. Additionally, the protective docking device can be stacked in position either with or without a voting machine attached therein. Another feature of this improvement is that the protective docking device can provide power and communication connections (including network connectivity) to the voting machine. The protective docking device can also provide loop-back connections on I/O ports to support external loop back tests.

Further, the docking device can have the necessary authentication devices in them for successful communication with the voting machines.

Furthermore, it is within the scope of the improvement that the voting machines can contain location tracking mechanisms such as unique barcodes and RFID tags.

Additionally, the plurality of protective docking devices can communicate location information of the voting machine to the asset tracking system.

Another improvement provides an asset tracking system that allows jurisdictions to accurately manage and account for their voting machine assets by allowing jurisdictions to monitor the locations of their voting machine assets both in the warehouse and in transit for an election. For example, the voting machine assets can be scanned when they are staged for shipment, scanned when they are loaded onto a truck or other vehicle, scanned when they are delivered to polling places, scanned when they are picked up from polling places and scanned when they are delivered back to the warehouse. The asset tracking system will then be able to track where the voting machine assets are in that lifecycle.

In the asset tracking system, each voting machine can have its own unique serial number identifier, which can be, for example, encoded in a bar code on the outside of the machine. Alternatively, the unique serial number identifier can be encoded in an RFID tag in the machine. Further, the RFID tag in the machine can be an RFID tag that is "read only."

Some improvements can further include asset tracking peripheral devices that are capable of reading the serial number identifiers of the plurality of voting machines via bar codes on the outside of the voting machines. In the case where the unique serial number identifiers are encoded in an RFID tag in the voting machines, the asset tracking peripheral devices are capable of reading the serial numbers of a plurality of voting machines via the RFID tags in the voting machines. These peripheral devices can consist of portable hand held devices containing supporting applications or fixed location devices directly connected to the asset tracking application.

One improvement also includes asset tracking applications that are capable of managing and tracking assets utilizing the serial number data collected from a plurality of voting machines that have unique serial number identifiers using a plurality of asset tracking peripheral devices. Further, the asset tracking peripheral devices are capable of communicating the serial number data to the asset tracking application.

Another improvement includes a tracking and preparation system for networked voting machines including a host computer, a plurality of voting machines connected via a network to the host computer, each voting machine having one or both of a wireless communication device and a data port for coupling to the host computer, and an election and voting machine preparation portion included in the host computer that is configured to manage and/or control the connected voting machines.

The election and voting machine preparation portion can be configured to manage the status of the connected voting machines, can be configured to instruct the voting machines to run self tests, can be configured to receive results of the self tests back from the connected voting machines, and can be configured to prepare/program the connected voting machines with an election ballot.

The self tests run by the voting machines can correspond to pre-LAT tests.

The election and voting machine preparation portion can be configured to open pre-LAT polls remotely over the network.

The election and voting machine preparation portion can also be configured to run simulation scripts on the voting machines over the network.

The election and voting machine preparation portion can further be configured to disable all network ports of the voting machines after the voting machines have been configured for an election.

Each voting machine can contain a location tracking mechanism. The location tracking mechanism can be a barcode and/or an RFID tag, for example.

Another improvement relates to a protective docking device for a voting machine. The protective docking device includes a voting machine accepting portion configured to accept and store a voting machine, a power connection portion to provide power to the voting machine stored in the voting machine accepting portion, a receiving portion on a top surface of the protective docking device that is configured to receive another protective docking device stacked thereon, a security authentication portion configured to manage interface ports and modes of operation of the voting machines, and a data connection port to provide a data connection to the voting machine stored in the voting machine accepting portion.

The protective docking device can include a plurality of docking stations, each docking station being configured to receive a voting machine.

The protective docking device can include a groove on a top surface of each of the docking stations.

The docking stations can be stacked in a tiered manner.

The protective docking device can include a bag on a back surface of each voting machine within each docking station to collect ballots that have been scanned by the voting machines.

Another improvement relates to a voting machine having an input portion, a network communication device, and a location tracking mechanism.

The voting machine can further include hardware interlocks that disable the network communication device to prevent the voting machine from being accessed via the network communication devices during an election.

BRIEF DESCRIPTION OF THE DRAWINGS

The foregoing and further objects, features and advantages of the invention will become apparent from the following descriptions of exemplary embodiments with reference to the accompanying drawings, in which like numerals are used to represent like elements and wherein.

DETAILED DESCRIPTION OF EMBODIMENTS

Figure 1:
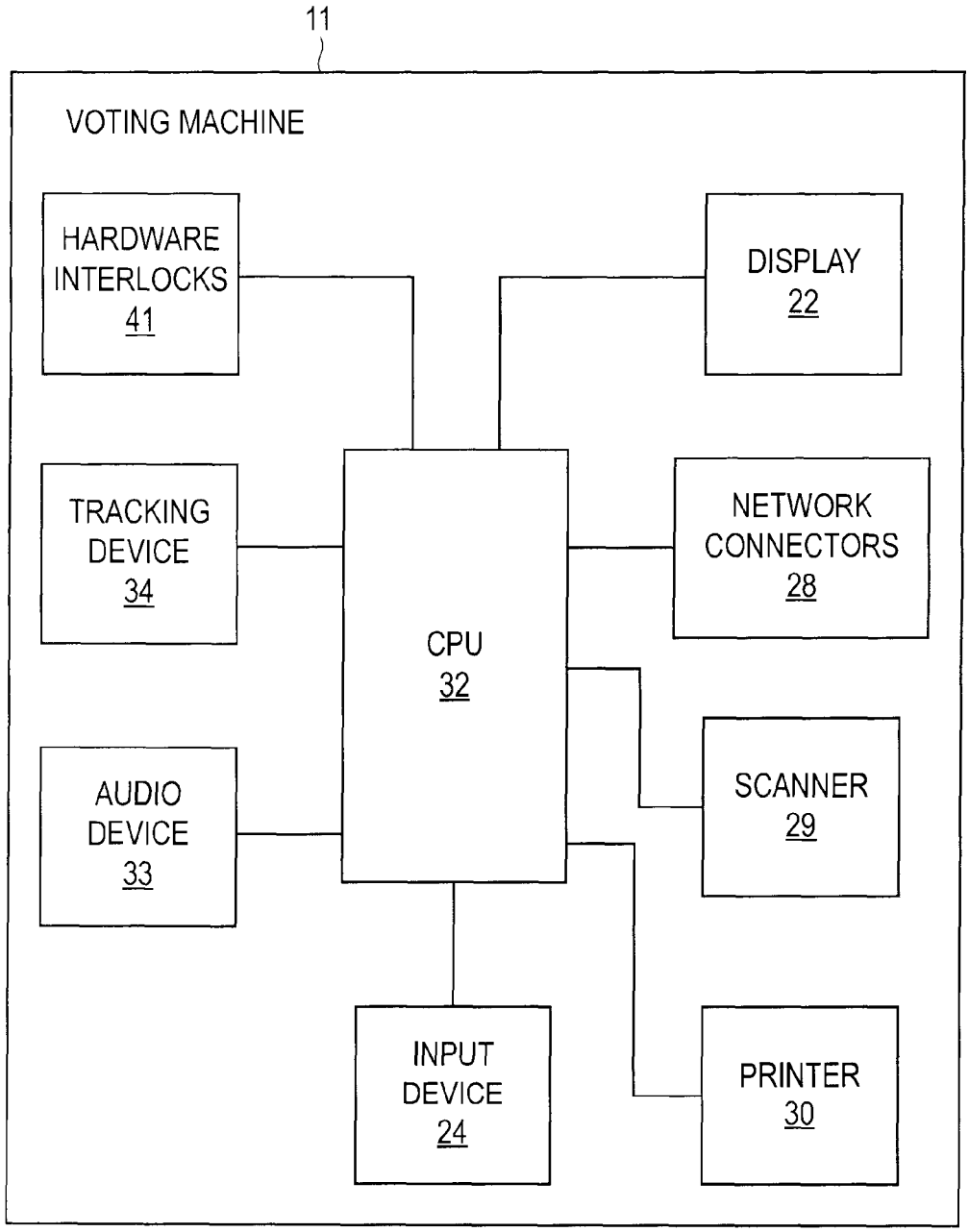
FIG. 1 is a diagram illustrating some of the components of a voting machine.

FIG. 1 illustrates some of the components that can be included in each voting machine 11. The voting machine 11 can include a CPU 32 that controls operation of the voting machine 11 including the functions described herein, a tracking device 34, an audio device 33, an input device 24, an optical scanner 29, a printer 30, network connectors 28 and a visual display unit 22. The network communication device (network connector 28) can be, but is not limited to: ethernet; optical; and wireless communication devices. Voting machine 11 is not limited to these specific components as any number of other components known to one of ordinary skill in the art for inclusion on voting machines 11 could be incorporated therein.

Additionally, the voting machine 11 can completely disable the network communication device 28 using hardware interlocks 41. The hardware interlocks 41 prevent the voting machine from being accessed via the network communication devices 28 during an election, for example. Further, the voting machine can run self tests such as, but not limited to: destructive memory tests; non-destructive memory tests; tests of I/O ports; I/O communication tests; detection of connected peripheral devices; tests of attached peripheral devices; detection of attached Removable Memory Elements (RME); tests of RMEs; and tests of power supplies and batteries (described below).

Figure 8:
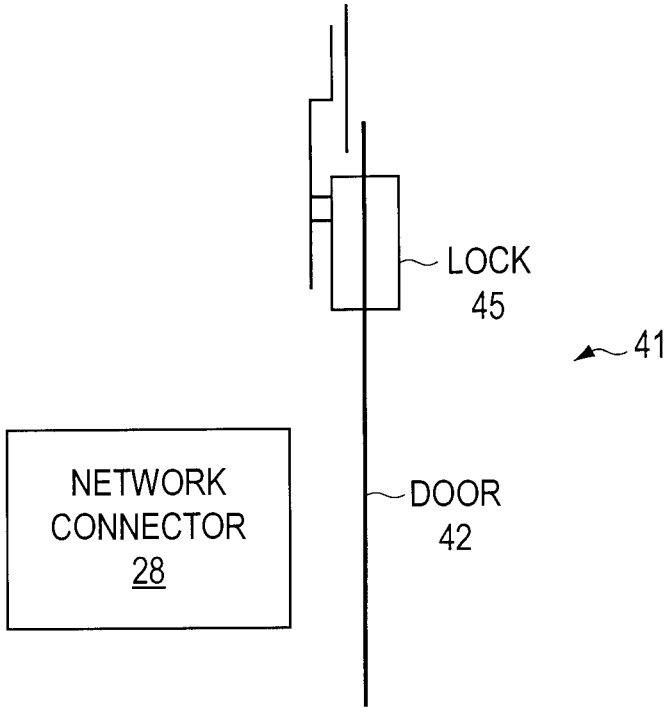
FIG. 8 is a diagram illustrating an example of a hardware interlock.

There are a variety of methods that can be employed to hardware interlock the secure RME element. A first implementation is to mount the RME port behind a door 42 that can be locked by a lock 45 and controlled by key access (see, for example, FIG. 8). In addition, a sensor (not shown) can be added to detect whether the door 42 is open or not. If the door 42 is open, an electrical interrupt can be activated to disconnect all power and signal lines connected to the RME port.

Figure 9:
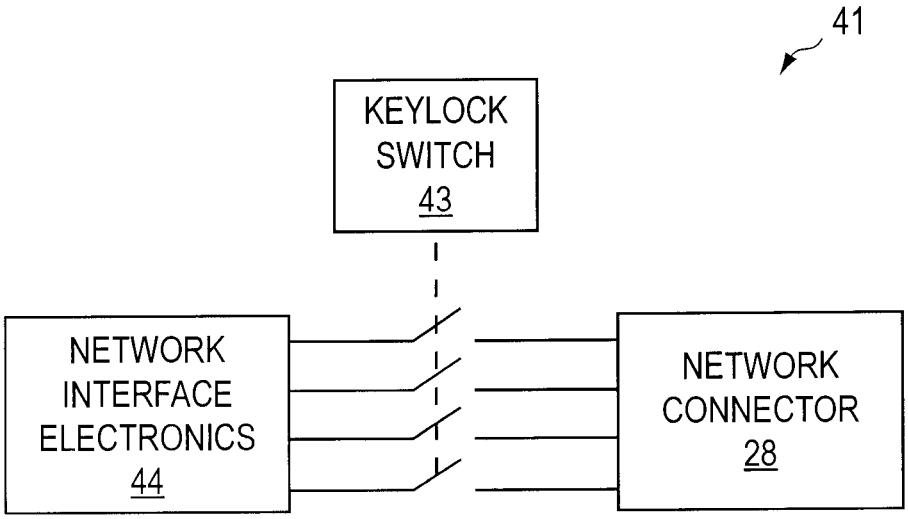
FIG. 9 is a diagram illustrating another example of a hardware interlock.

FIG. 9 illustrates another embodiment of a hardware interlock 41 where a connection between network interface electronics 44 and network connector 28 is disrupted by a keylock switch 43.

To facilitate the preparation of voting machines 11 prior to an election, the voting machines 11 can be remotely instructed to run the self tests mentioned above from over the network and can communicate the results of the tests back over the network. That is, in the warehouse, for example, a plurality of voting machines 11 can be coupled to a host computer over a network using the network connectors 28. The host computer 10 can then control and/or monitor the plural voting machines 11.

The network communication device 28 in each voting machine 11 enables the voting machine 11 to be configured and tested remotely. Examples of how voting machines 11 can be configured can include, programming the voting machines 11 with an election ballot over the network, performing validation of a loaded election ballot, and communicating results of that validation back over the network.

Additionally, the network communication device 28 enables the voting machines to have polls opened in pre-LAT mode remotely over the network. Pre-LAT polls mode is a standard mode of operation for a voting device for conducting Pre election Logic and Accuracy tests. Further, the communication device enables the voting machines 11 to be provided with a vote simulation script over the network. A vote simulation script is a set of commands that can simulate voting patterns on the machine even to the level of providing pre-canned scanned ballot images or PDF images of ballots with machine generated marks for testing the vote interpretation engine on the tabulator. The communication device 28 also enables the voting machines 11 to be remotely instructed to run pre-LAT activities such as interpreting vote simulation scripts and images, performing image calibration procedures, verifying all system components for readiness and proper function, self printer test etc. Finally, results of all Pre-LAT tests can be communicated back to the EMS through the communications device 28.

Further, the network communication device 28 allows the voting machines 11 to have pre-LAT polls opened remotely over the network, have pre-LAT polls closed remotely over the network and can communicate pre-LAT results back over the network. Additionally, the pre-LAT polls can be closed manually and can communicate pre-LAT results back over the network.

Thus, the voting machines 11 can be programmed with an election ballot from over the network, have pre-LAT polls opened remotely over the network and then disable all network ports thru the tabulator firmware and software. Further, the voting machines 11 can be programmed with an election ballot from over the network, have pre-LAT polls opened remotely over the network, have pre-LAT polls closed manually and then disable all network ports.

Use of a Network to Prepare Voting Machines

Typically the warehouse process cycle consists of the following functions (see FIG. 3): Storage and maintenance 100; Test 101; Repair 102; Machine Preparation 103; Pre-LAT 104; Distribution 105; Acceptance back after election 106; and Escrow storage 107.

Figure 3:
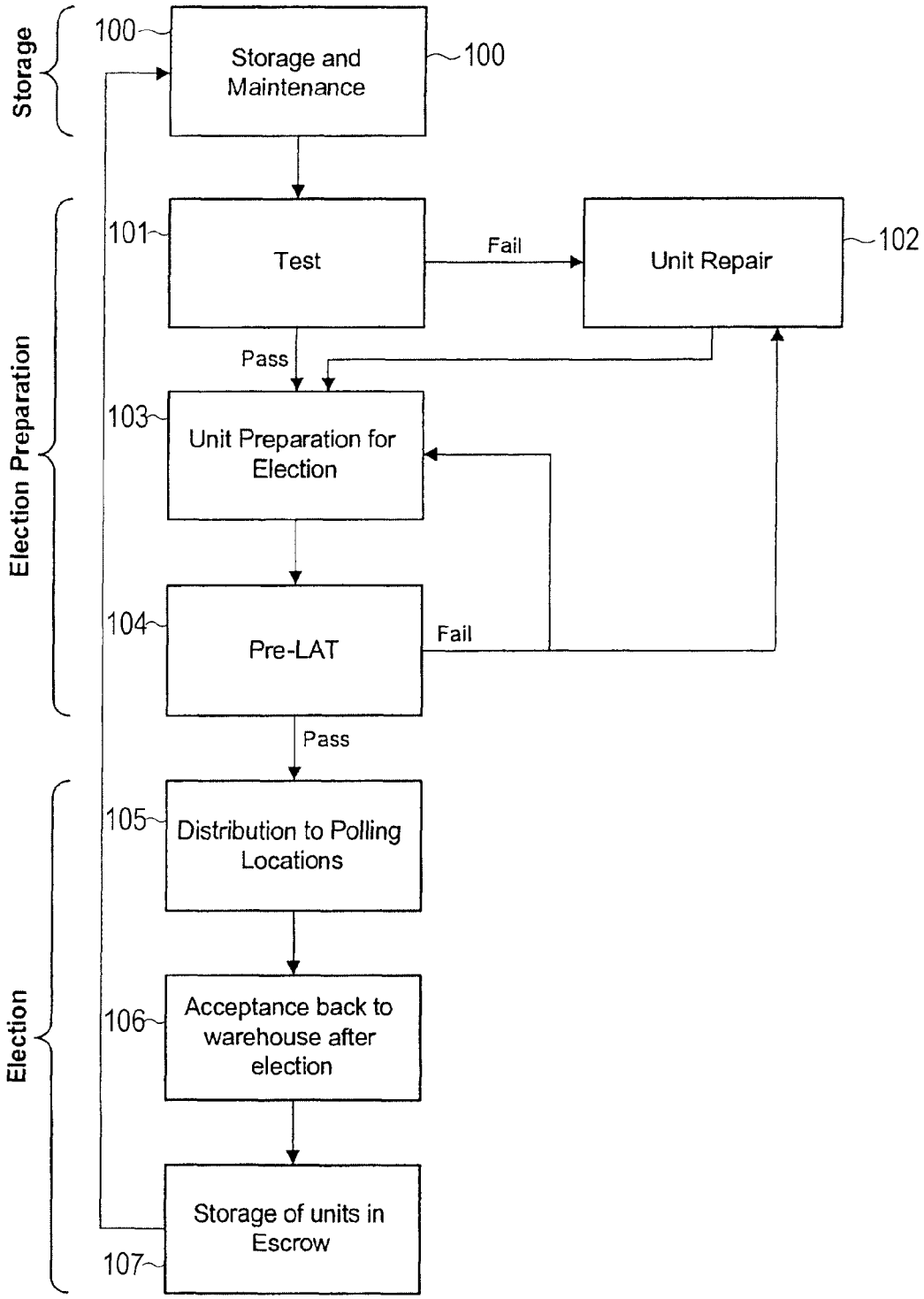
FIG. 3 is a diagram illustrating an example of a warehouse process cycle.

The functions listed above, and illustrated in FIG. 3, represent a major logistical effort in large jurisdictions. For example, a jurisdiction has to store its voting machines 11 in a benign environment and keep them charged. Prior to an election, the jurisdiction must test every voting machine 11 to ensure it is operational and repair those that are not. Further, the jurisdiction must then prepare each individual voting machine 11 with the ballot styles for the precinct to which the voting machine 11 is assigned. The preparation and machine function must then be validated against that expected in pre-LAT. The voting machines 11 that fail the "pre-LAT" process must either be re-prepared or repaired, depending on the issue. The voting machines 11 must then be distributed to the correct locations in a secure manner, where they are used in the election. After the day of election, the voting machines 11 then must be collected and returned to the warehouse and accounted for, where they are stored in escrow (securely) for auditing purposes. The voting machines 11 are finally retuned to their normal storage modes after auditing or after it is determined that auditing is not needed.

For a jurisdiction with just a few voting machines 11, this process is not a major issue. However, for a large jurisdiction, such as a jurisdiction with 5,000 or more voting machines 11, this presents a major logistical problem. Anything that can be done to automate this process and thus reduce the logistical burden on the jurisdictions will be extremely useful. Some of the improvements discussed herein achieve this goal. To solve this problem, the voting machines 11 are networked together to a central management system within the warehouse. Additionally, one improvement includes a software application that assists in the management and implementation of the process.

In order to address this logistical problem, all the voting machines 11 are networked together in the warehouse, either with physical network connections or via wireless technology, in their storage positions. Additionally, the voting machines 11 are supplied with power and operate in a special storage mode of operation when in storage. A warehouse management application is used that is capable of sending commands to and receiving data from, the individual voting machines 11, groups of voting machines 11, lists of voting machines or the entire group of voting machines 11 that are stored in the warehouse.

Additionally, the warehouse management application is capable of sending a command instructing voting machines 11 to respond by identifying their location in the warehouse and their current status. The networked voting machines 11 then respond by providing the appropriate data. The voting machines 11 are able to report their location by where they are networked and the status information that includes amongst other information, the firmware version, battery level, current mode of operation, whether the voting machines 11 have results cartridges present and the current configuration of the voting machines 11. This feature allows the warehouse management application to verify the location of the voting machines 11 and receive information regarding the status of each voting machine 11.

Further, the warehouse management application is capable of sending a command instructing the voting machines 11 to run a series of diagnostic tests. The purpose of these tests is to ensure that the hardware is operating correctly. The tests include, but are not limited to the following tests listed below.

| | | |
|---|---|---|
| Internal Memory Tests | Destructive RAM test | This tests the RAM by writing data to memory address and reading it back to verify that it has written correctly. It is called destructive because any data residing |

-continued

| | | |
|---|---|---|
| | | in the memory is lost. |
| | Non-Destructive RAM tests | This tests the RAM by writing data to memory addresses that are not currently in use and reading it back to verify that it has written correctly. |
| | Destructive storage memory tests | This tests the storage memory (such as CF, hard disk etc.) by writing data to memory address and reading it back to verify that it has written correctly. It is called destructive because any data residing in the memory is lost. |
| | Non-Destructive storage memory tests | This tests the storage memory (such as CF, hard disk etc.) by writing data to memory addresses that are not currently in use and reading it back to verify that it has written correctly |
| Removable Memory Element (RME) Tests | Destructive RME tests | This tests the Removable Memory Element (RME) (results cartridge) by writing data to memory addresses and reading it back to verify that it has written correctly. It is called destructive because any data residing in the memory is lost. |
| | Non-Destructive RMW tests | This tests the Removable Memory Element (RME) (results cartridge) by writing data to memory addresses that are not currently in use and reading it back to verify that it has written correctly. |
| Serial Port Tests | Internal tests | These tests test the serial ports by performing internal chip set and internal loop back tests, by transmitting and receiving data in the various modes supported by the chipset. |
| | Loop-back tests | This tests the serial ports by performing an external loop back tests, by transmitting and receiving data over the port. The serial ports must have a connector that connects the Tx and Rx lines. |
| | Authentication Tests | This test authenticates any devices currently attached the serial ports of the voting machine. |
| USB Port Tests | Internal tests | This tests the USB ports by performing internal chip set and internal loop back test, by transmitting and receiving data in the various modes supported by the chipset. |
| | Loop-back tests | This tests the USB ports by performing an external loop back tests, by transmitting and receiving data over the port. The USB ports must have a connector that interfaces the Tx and Rx lines. |
| | Authentication Tests | This test authenticates any devices currently attached the serial ports of the voting machine. |
| Ethernet Tests | Internal tests | This tests the ethernet port by performing internal chip set and internal loop back tests, by transmitting and receiving data in the various modes supported by the chipset. |
| | Loop-back tests | This tests the ethernet port by performing an external loop back test, by transmitting and receiving data over Ethernet connection with the warehouse application. |
| Wi-Fi Tests | Internal tests | This tests the Wi-Fi connection by performing internal chip set and internal loop back tests, by transmitting and receiving data in the various modes supported by the chipset. |
| | Loop-back tests | This tests the Wi-Fi connection by performing an external loop back test, by transmitting and receiving data over Wi-Fi connection with the warehouse application. |
| | Authentication Tests | This test authenticates the data encryption and certificates used in the Wi-Fi connection |
| Other Port Tests | Internal tests | This tests the other ports by performing internal chip set and internal loop back tests, by transmitting and receiving data in the various modes supported by the chipset. |
| | Loop-back tests | This tests the other ports by performing an external loop back tests, by transmitting and receiving data over the port. The ports must |

-continued

| | |
|---|---|
| | have a connector that connects the Tx and Rx lines. |
| Authentication Tests | This test authenticates any devices currently attached the other ports on the voting machine. |
| Processor Tests | This tests the operation of the processor. |
| Security Tests | These are a suite of tests that test the security features of the voting machine. |
| Display communication tests | This tests the connections to the displays and the touch screen membrane. |
| Firmware authentication tests | This authenticates the version of the firmware by calculating a HASH value of the firmware image using a seed passed to it by the warehouse application. |
| Audit/event logging tests | These tests test the audit and event logging facilities by simulating events and then checking that the events have been written to the logs. |
| Printer tests | This tests the operation of the printer and or VVPAT connected to the voting machine. |
| Battery Charging tests | This tests the battery charging circuits and the state of the battery. |
| Audio sub-system tests | This tests the correct operation of the audio sub-system. |
| ADA device interface tests | These test the interfaces provided for the use of ADA devices, for example the audio control unit. |

After the tests have been run, the voting machines 11 report back the results of the tests identified above to the warehouse management application. The warehouse management application is then able to identify which voting machines 11 have problems via these tests. This allows the voting machines 11 to be tested remotely without human intervention, thereby reducing the time required to prepare the voting machines for an election.

Figure 2:
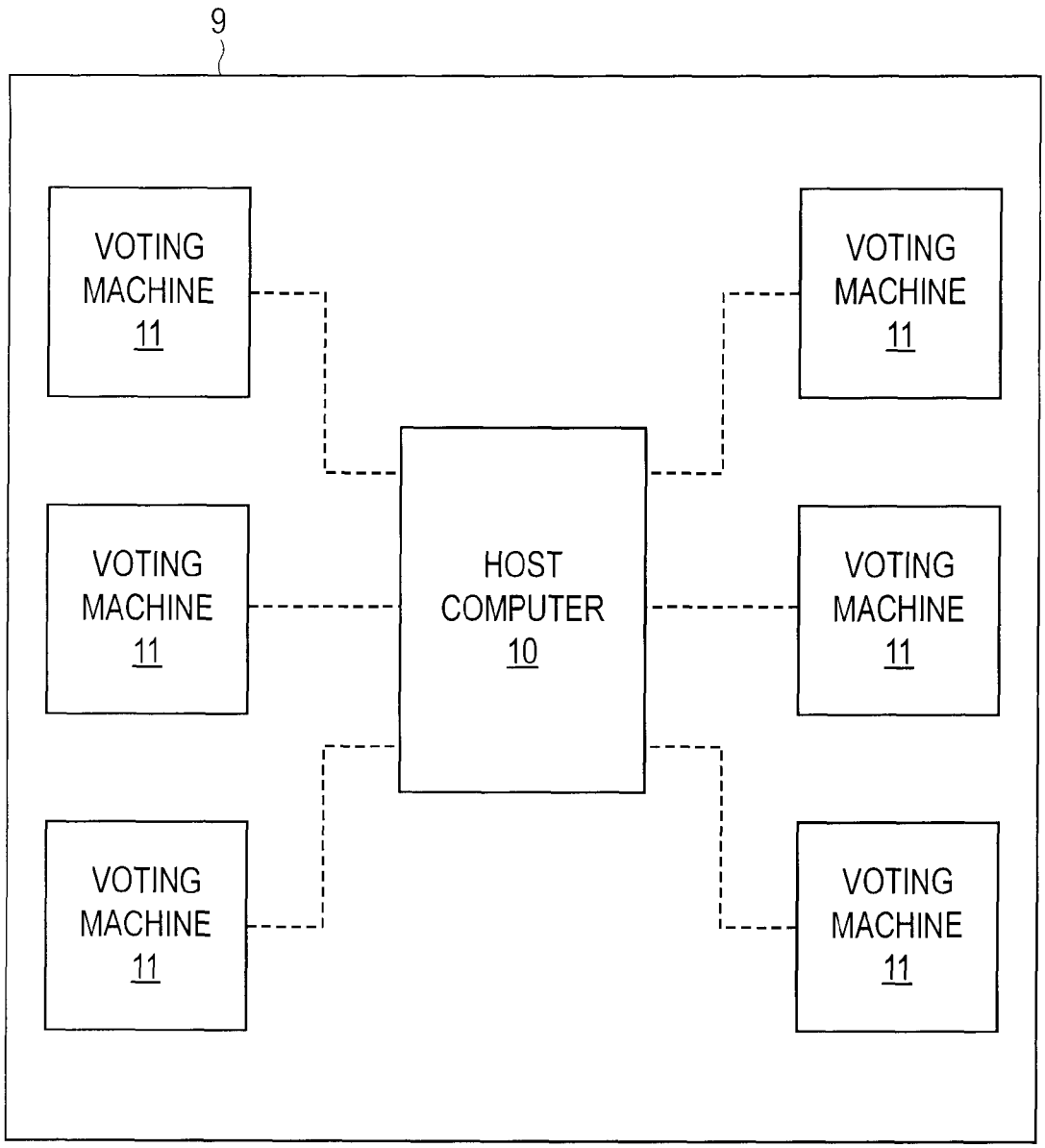
FIG. 2 is a diagram illustrating an example of warehouse networking system.

Further, the warehouse management application is capable of setting system parameters in the voting machines 11, such as setting the date and time as well as being capable of loading election definitions into the machines across the network. Once the election definitions are received, the voting machines 11 authenticate and verify the election definition and copy it to all necessary memory devices including any internal storage devices, and redundant removable memory elements, verifying that it has loaded correctly. The voting machines 11 then report their status back to the warehouse management application. The warehouse management application tracks and manages which voting machines 11 have been prepared successfully and which have had election load issues and thus may require further attention. FIG. 2 illustrates an example of the warehouse management system in a warehouse 9 including host computer 10, and voting machines 11 that are, in this embodiment, connected to the host computer 10 via a wireless network. The host computer 10 includes RAM, ROM one or more CPUs and various interfaces. The warehouse management application is stored on and runs on the host computer 10.

This allows the voting machines 11 to be prepared for an election with the election definition automatically without human intervention.

The warehouse management application also is capable of loading simulation scripts to the voting machines 11. The voting machines 11 authenticate and verify the simulations scripts and report the status of the load back to the warehouse management application. The warehouse management application is capable of instructing voting machines 11 to open polls in pre-LAT and to run the vote simulation scripts. The voting machines 11 then report the status to the warehouse management application.

The warehouse management application can also instruct the voting machines 11 to open polls in pre-LAT mode, and to accept manual feeding of a deck of test ballots. Once the ballots have been fed into the voting machine 11, a sequence can be initiated on the voting machine 11 to reconnect with the warehouse management application to transmit the results of the test deck for verification and validation.

These pre-LAT based processes using either a vote simulation script, or a set of test ballots allows the vast majority of pre-LAT to be run automatically without human intervention. Some pre-LAT tests may have to be done manually, such as verifying that: the user interface works correctly; that the scanner mechanism is operating correctly; that test ballots are read correctly; that the audio voting works correctly; and that the printer prints correctly. However, the tests capable of being conducted remotely represent a large reduction in the effort required to prepare the voting machines 11.

The warehouse management application is capable of instructing voting machines 11 to close pre-LAT polls and to tally the pre-LAT data. The voting machines 11 then report the pre-LAT tally data back to the warehouse management application. The warehouse management application then compares the pre-LAT data with what was expected to automatically verify that pre-LAT was successfully passed. These measures allow pre-LAT to be conducted accurately and with minimum effort.

The warehouse management application also is capable of instructing the voting machines 11 to open polls in official election mode and the voting machines 11 then report this back to the warehouse management application.

Thus, the entire voting machine preparation and test process can be automated and the required effort to test and prepare the voting machines can be considerably reduced.

The warehouse management application also is capable of instructing the voting machines 11 to send their audit and event logs and is being capable of searching for certain types of events. The voting machines 11 can also send back their election tally data (ballot image records) if polls have been closed.

One improvement relates to election and machine preparation applications running on a host computer system connected by a network to a plurality of voting machines 11 that each includes a network communication device via that network (see FIG. 2). One function of the election and machine preparation applications is to manage the status of the connected voting machines 11. Additional functions of the election and machine preparation applications are to instruct the voting machines 11 to run self tests (listed below), to receive the results of those self tests back from the voting machines 11, and to display and archive the results. Any errors or issues identified can be communicated back to the user of the system thru these reports and communicated to the warehouse logistics management in order for the machines to be serviced.

Another function of the election and machine preparation applications is to prepare/program those voting machines 11 with an election ballot over the network. In addition, the election and machine preparation applications are capable of receiving verification that the ballot has loaded correctly.

Further, another function of the election and machine preparation applications is to instruct the voting machines that have an election ballot loaded but have not had any polls opened to open pre-LAT polls. The election and machine preparation applications can then receive verification back that pre-LAT polls were opened successfully.

The election and machine preparation applications are also able to provide a vote simulation script to the voting machines 11 that have pre-LAT polls open. The election and machine preparation applications can then receive verification that the simulation script was successfully loaded.

The election and machine preparation applications can also suspend operation after pre-LAT polls have been opened so that a set of test ballots can be manually fed into the system. Once the ballot has been fed, the pre-LAT polls can be manually closed and the results of the test ballots communicated back to the preparation system for verification.

The election and machine preparation applications also can provide those machines 11 that have pre-LAT polls open with instructions to close pre-LAT polls, and the election and machine preparation applications can receive verification that the ballots have been validated, and that pre-LAT polls have been closed successfully.

The election and machine preparation applications can further provide data on the operational health, pre-LAT data and polls status of the voting machines as well as data on the location in the warehouse of those voting machines Voting Machine Docking and Storage Station A storage and docking station is designed specifically for each type of voting machine 11. This allows the voting machines 11 to be stored safely and protected from damage. Further, the storage and docking station allows the voting machines 11 to be stacked. The storage and docking station also is capable of providing power to the machines for battery charging and network connectivity, if supported, for connection to a warehouse management application. The docking station can also provide connection to support various I/O port loop back tests. The docking station also is capable of providing security authentication, which allows the voting machine to activate various interface ports and support various modes of operation.

Figure 4:
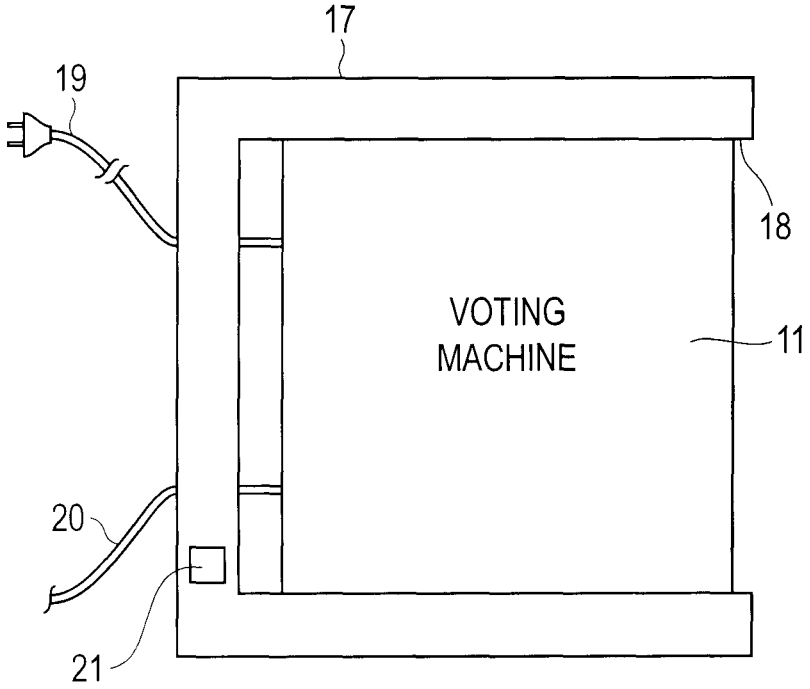
FIG. 4 is a diagram illustrating an example of a voting machine in a protective docking station.

FIG. 4 illustrates an exemplary embodiment of the storage and docking station 17. As seen in FIG. 4, the storage and docking station 17 includes a cavity 18 into which the voting machine 11 can be placed. FIG. 4 also illustrates some of the plugs and interfaces provided in the storage and docking station 17 for connection with the voting machine 11. As seen in FIG. 4, these connections can include, for example, a power connection 19 and a data line 20. In some examples, the storage and docking station 17 may comprise a channel 21 provided near a back portion of the docking station 17 to provide a conduit for the cables such as power connection 19 and a data line 20 connected to the voting machine 11.

Figure 5:
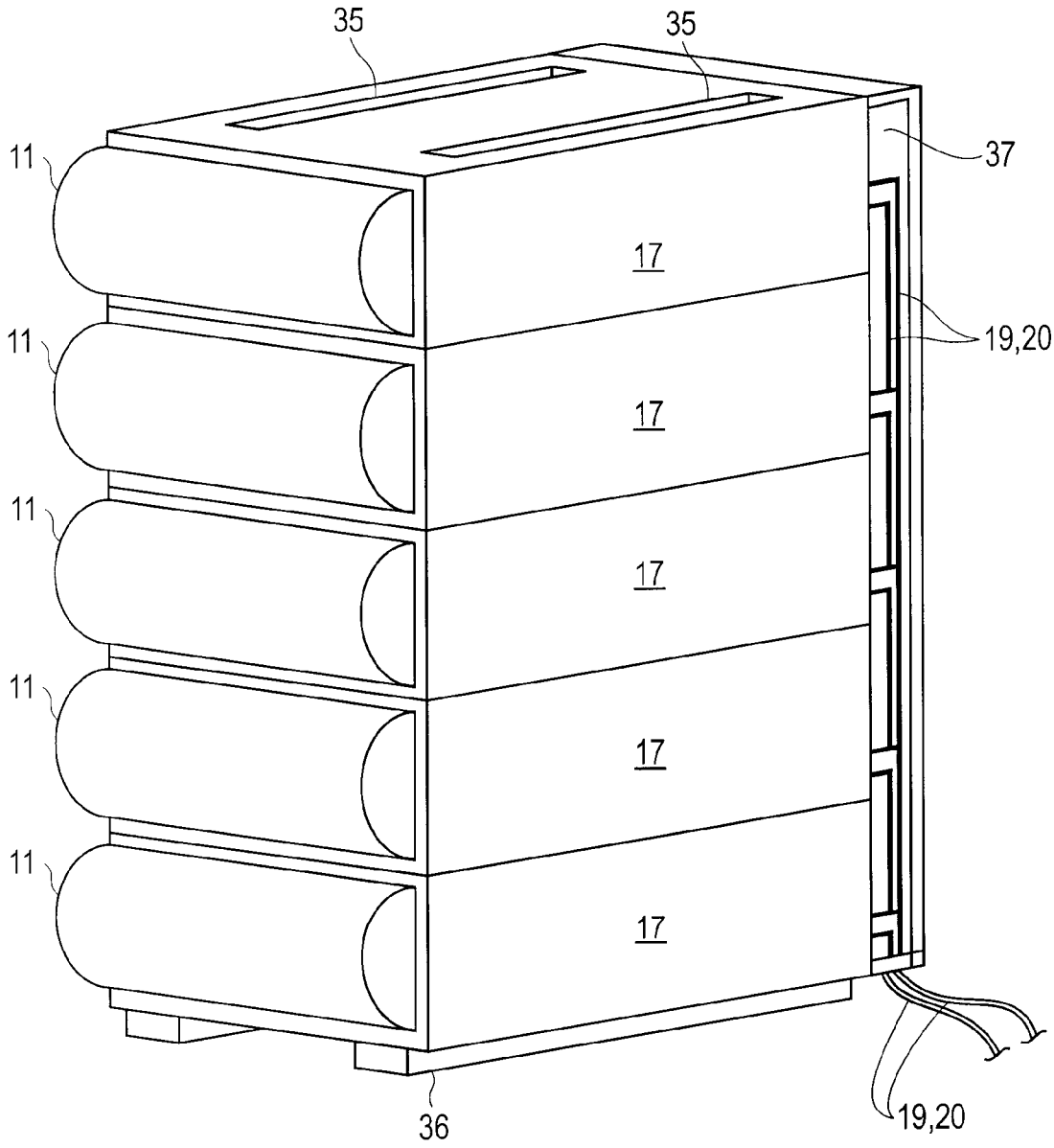
FIG. 5 is a diagram illustrating an example of a protective docking station in a stacked configuration.

FIG. 5 illustrates how the storage and docking station 17 can be stacked on top of another storage and docking station 17. As seen in FIG. 5, in one embodiment, each docking station 17 can be placed directly on top of the other. Grooves 35 are provided on a top surface of each docking station 17 to facilitate stacking. The grooves 35 are configured to receive a corresponding projecting portion 36 on the bottom surface of another docking station 17. Additionally, a channel 37 is provided near a back portion of each docking station 17 to provide a conduit for the cables such as a power connections 19 and a data lines 20 connected to each voting machine 11.

Figure 6:
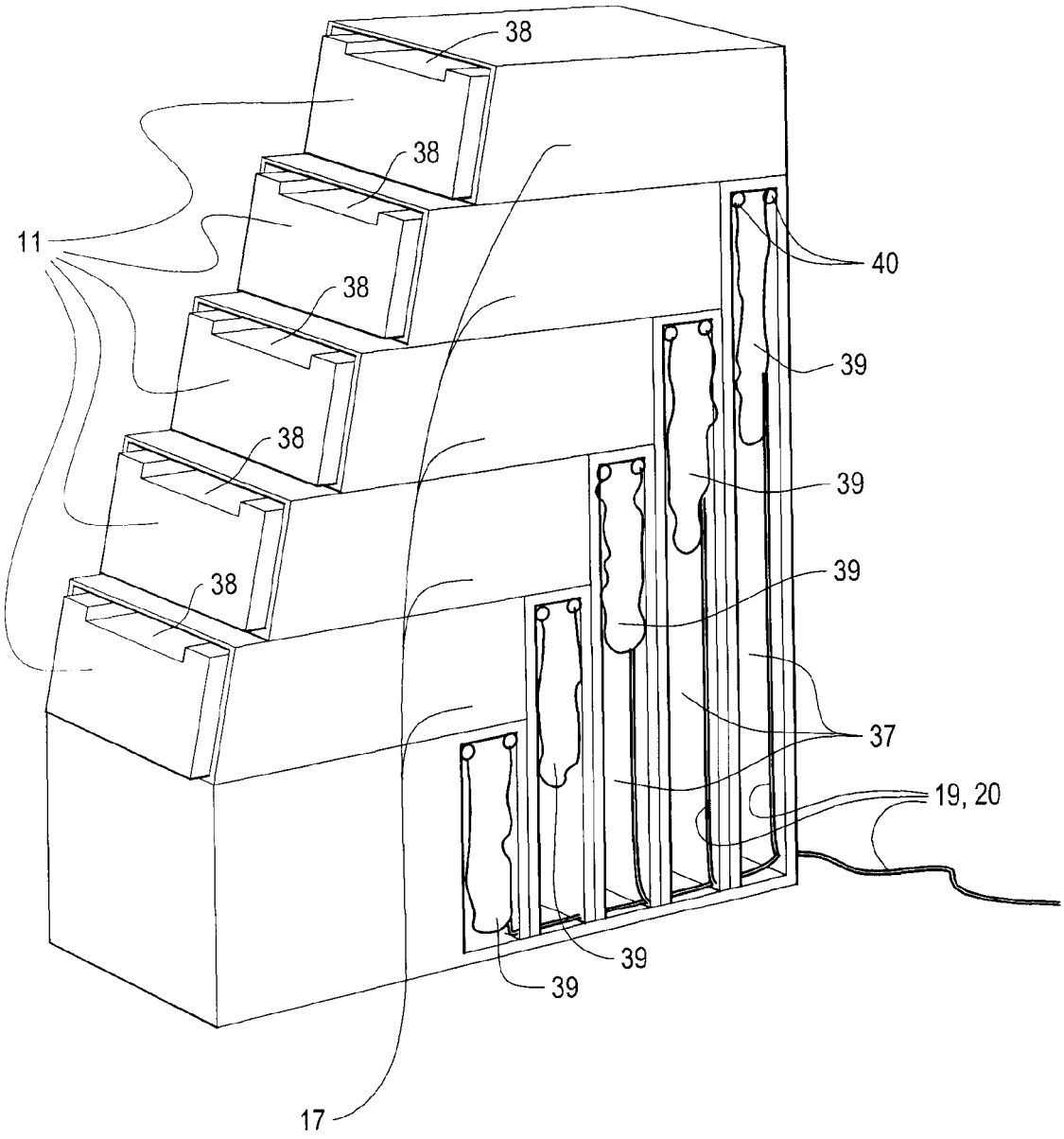
FIG. 6 is a is a diagram illustrating an example of a protective docking station in a stacked tiered configuration.

FIG. 6 illustrates another embodiment of the stacked docking stations 17. In this embodiment, the docking stations 17 are stacked in a tiered manner. Additionally, in this embodiment, the docking stations 17 are configured to allow ballots 1 to be fed into ballot feed trays 38 of the optical ballot scanner 29 in each voting machine 11 while the voting machines 11 are stacked. Therefore, the voting machines 11 do not need to be un-stacked to feed ballots during pre-LAT.

Similar to FIG. 4, in the embodiment of FIG. 5, a channel 37 is provided near a back portion of each docking station 17 to provide a conduit for the cables such as a power connection 19 and a data line 20 connected to each voting machine 11.

Further, a bag 39 is provided on a back surface of each voting machine 11 to collect ballots that have been scanned. The bags 39 can be disposed on runners 40 so that the bags 39 can slide out to facilitate the removal of the ballots from the voting machines 11.

Asset Tracking of Voting Machines

Each individual voting machine 11 can be configured with machine-readable identifiers on/in them such as bar codes or RFID devices. These are generally referred to as a tracking device 34 shown in FIG. 1. These machine-readable identifiers can contain information such as, for example, the machine type and serial number. These identifiers can also be used to track the location and 'state' of the voting machines 11 within the election lifecycle.

The machine-readable identifiers are capable of being scanned by devices such as barcode scanners and RFID scanners so that the information can be retrieved and used by the tracking and warehouse applications. RFID is preferable as it allows automatic scanning of the devices without the need for manual interaction by a user.

When a voting machine 11 is stored in the warehouse, the voting machine 11 is scanned for its identifier information and its location is recorded. If the machine-readable identifier is contained in barcode, then the user will have to scan that bar code with a bar code reader. If the identifier is contained in an RFID tag, then this can be scanned automatically either by a hand held device or by a scanning device located in the storage area. The location of the voting machine 11 can be inputted in a number of ways. For example, the location of the voting machine 11 could be entered manually by the user, scanned in via a bar code identifying the location, or scanned in via an RFID tag at the location. If the voting machine 11 has an RFID tag, and the RFID scanners are located in warehouse storage area, the location of the voting machine 11 can be calculated automatically via comparing the relative strength of the RFID signals or by some other comparative technique. This identification and location information can be automatically passed to the warehouse management and asset tracking systems, preferably via a wireless network. These applications mark the voting machines as being in a warehouse storage location and record that particular location. Hence the location of a particular voting machine 11 is known and verified.

When a voting machine 11 is removed from storage, a similar process occurs. The machine-readable identifier is scanned. Additionally, the reason for the voting machine 11 being moved can be entered into the system, preferably via a button press on a hand held device (which can include multiple selections from which to choose). Therefore, if the voting machine 11 has an RFID tag, the fact that it has been moved from the storage location may be detected automatically. Again, this information can be passed to the asset tracking system, so that its location is still known.

If the voting machine 11 is taken to a different location, such as a pre-LAT or audit area (for example to complete the manual aspects of pre-LAT prior to staging for deployment), then the voting machine 11 can be scanned and information such as the voting machines' 11 presence in that different location and that part of the process can be recorded and passed to the asset tracking and warehouse management applications.

If the jurisdiction uses a staging area prior to distribution of the voting machines 11, then when the voting machines 11 are placed in that area, the fact that the voting machines 11 are there and the particular location in that area can be recorded using similar means as described above with respect to the storage location at the warehouse.

Additionally, vehicles that are used for delivery of the voting machines 11 can also have machine-readable identifiers. Again, these machine-readable identifiers could be stored via barcodes or RFID tags. As voting machines 11 are deployed onto vehicles for delivery, they can be scanned and the vehicle identifier scanned. If the vehicle does not have a barcode or RFID tag, then the identifier could be entered manually. This information can then be relayed back to the asset management application, so that the presence of the voting machines 11 on a particular vehicle can be tracked.

In addition, each polling place also can have a machine-readable identifier. These machine-readable identifier could be stored, for example, as barcode or MD tags at the polling place; as codes or barcodes on the delivery sheet; as codes or barcodes in a booklet; or be stored in the hand held device used of scanning for manual selection. If the polling place identifier is contained in a barcode or RFID tag, this can be scanned by the handheld device. If the machine-readable identifier is a code, it can be manually entered in the handheld device. Further, if the machine-readable identifier is stored in the application in the handheld device, then it can be manually selected by the user. When a voting machine 11 is delivered, its ID can be scanned by the handheld device as is the polling place ID. This information is stored in the hand held device. If the process includes an acceptance by someone at the polling place, this can also be recorded in the hand held device (depending on the technology in the hand held device, this could be a signature, a thumb print, an acceptance code or just a button press). If an attempt is made to transport the voting machine 11 to an incorrect location, the handheld device can identify this and warn the user.

When the vehicle returns to the warehouse, the data collected can then be downloaded to the asset tracking application. Hence, the asset tracking application will know what voting machines 11 have been delivered and where the voting machines 11 are located. The asset tracking application also can identify if voting machines 11 have been incorrectly delivered.

When voting machines 11 are picked up from polling locations, the voting machines 11 can be scanned by the hand held device to show they have been collected. Similarly, when the voting machines 11 are placed back into storage or an escrow location, they can be scanned so that the location and this information can be relayed to the asset tracking system.

By using this process and information, the asset tracking system can accurately track the location and state of the voting machines 11. Therefore, if a voting machine 11 is mislaid, its path can be investigated to aid finding the voting machine 11. In the warehouse, if a voting machine 11 needs to be retrieved (for example, if it requires repair or is going to be audited) then the asset tracking system can identify its location for easy retrieval.

In addition, results cartridges can also have machine-readable identifiers, which can be in the form of barcodes or RFD tags, so that the results cartridges can be tracked in a similar manner as described above. The results cartridges can be scanned when inserted into a machine (which can be a voting machine or another machine) and that information can be relayed back to the warehouse management system so that a specific results cartridge can be associated with a specific voting machine 11. This step is not necessary if there is a networked warehouse management system in use as this can be done automatically via the warehouse management system.

If results cartridges are collected separately from the voting machines 11 at the end of the election, then as they are delivered to the tally center, they can be scanned in and tracked. Thus, a record can be kept of which cartridges have been delivered and the time of delivery.

Figure 7:
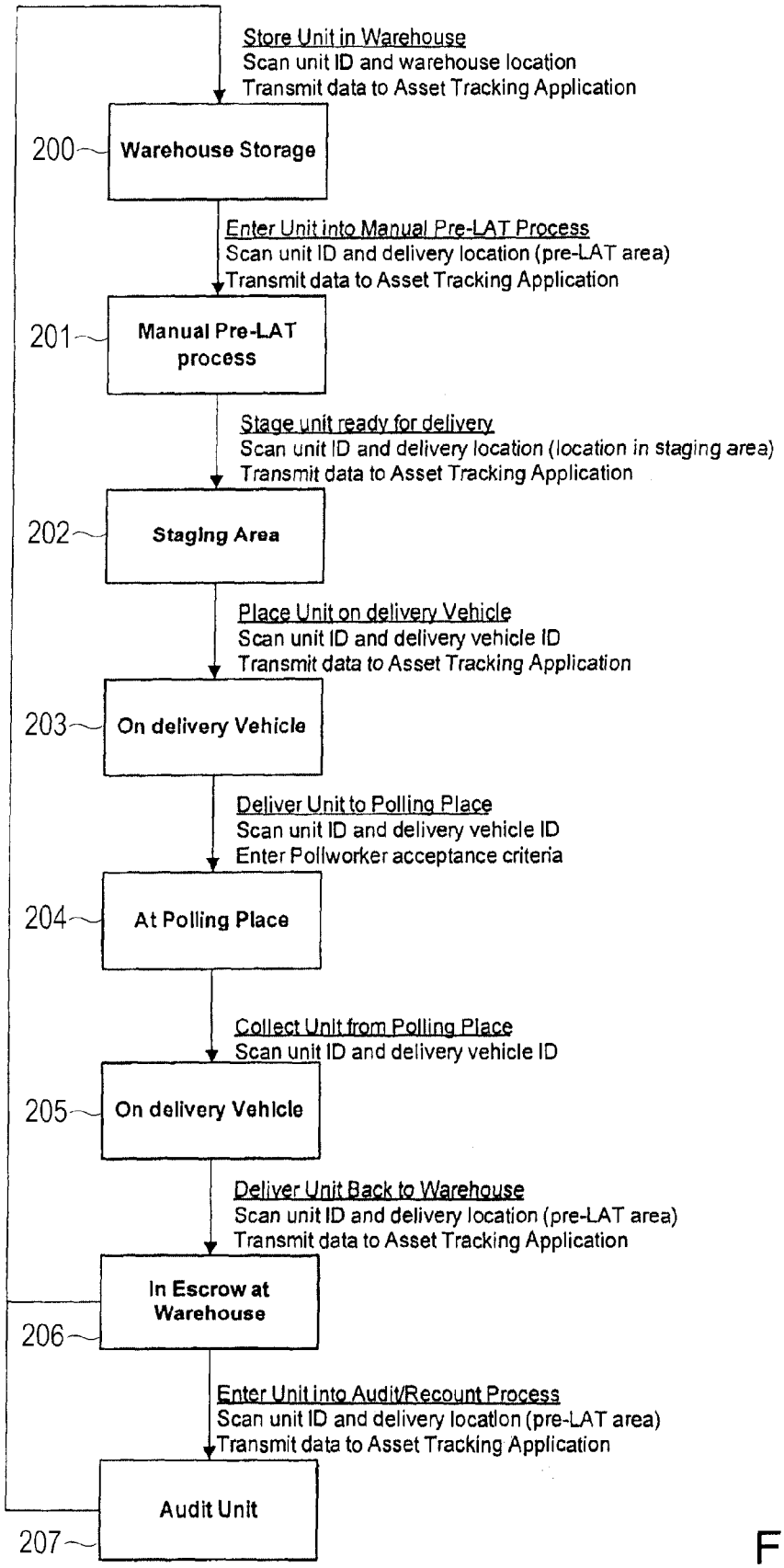
FIG. 7 is a flowchart illustrating an example of a process of asset tracking of voting machines.

FIG. 7 is a flowchart illustrating one example of how the asset tracking process can function. In step 200 the machine-readable identifier of the voting machine 11 is scanned and the location of the voting machine 11 is recorded and transmitted to the asset tracking application. In step 201 the machine-readable identifier of the voting machine 11 is scanned and the delivery location at the pre-LAT area is recorded and transmitted to the asset tracking application. In step 202 the voting machine 11 is ready for delivery and the machine-readable identifier of the voting machine 11 is scanned and the location of the staging area of the voting machine 11 is recorded and transmitted to the asset tracking application. In step 203 the voting machine 11 is placed on a delivery vehicle after scanning the machine-readable identifier of the voting machine 11 and the vehicle ID. This information is then transmitted to the asset tracking application. In step 204 the voting machine 11 is positioned at the polling place after scanning the machine-readable identifier of the voting machine 11 and the delivery vehicle ID. Additionally, when arriving at the polling place the poll worker acceptance criteria is entered. In step 205 the voting machine 11 is placed back on the delivery vehicle after having the machine-readable identifier of the voting machine 11 and the delivery vehicle ID scanned. Once again, this information is then transmitted to the asset tracking application. In step 206 the voting machine 11 is returned back to the warehouse where it is put in escrow. The machine-readable identifier of the voting machine 11 is scanned upon arriving back at the warehouse as well as the delivery location (pre-LAT area). This information is then transmitted to the asset tracking application. Finally, in Step 207 the voting machine 11 enters the audit/recount process. The machine-readable identifier of the voting machine 11 and the delivery location are scanned and the data is transmitted to the asset tracking application. Upon the completion of step 207 the cycle returns back to warehouse storage step 200.

The foregoing description is considered as illustrative only of the principles of the improvements discussed above. The inventions described herein are not limited to specific examples provided herein.

What is claimed is:

1. A tracking and preparation system for networked voting machines comprising:

a host computer;

a plurality of voting machines connected via a network to the host computer, each voting machine comprising:

a processor;

a user interface coupled with the processor and configured to receive cast votes;

a network communication device coupled with the processor, the network communication device comprising a wireless communication device and a data port for coupling the voting machine to the host computer; and a hardware interlock coupled with the network communication device and configured to disable the network communication device to prevent the voting machine from being accessed via the network during an election period, wherein disabling the network communication device comprises activating an electrical interrupt to prevent network communication with the voting machine while maintaining a physical network connection; and an election and voting machine preparation portion included in the host computer that is configured to distribute programming information to each of the connected voting machines prior to receiving the cast votes at the polling location.

2. The system according to claim 1, wherein the election and voting machine preparation portion is configured to manage the status of the connected voting machines, is configured to instruct the voting machines to run self tests, is configured to receive results of the self tests back from the connected voting machines, and is configured to prepare/program the connected voting machines with an election ballot.

3. The system according to claim 2, wherein the self tests run by the voting machines correspond to pre-LAT tests.

4. The system according to claim 2, wherein the election and voting machine preparation portion is configured to open pre-LAT polls remotely over the network.

5. The system according to claim 2, wherein the election and voting machine preparation portion is configured to run simulation scripts on the voting machines over the network.

6. The system according to claim 2, wherein the election and voting machine preparation portion is configured to disable all network ports of the voting machines after the voting machines have been configured for an election.

7. The system according to claim 2, wherein each voting machine contains a location tracking mechanism.

8. The system according to claim 7, wherein the location tracking mechanism is a barcode.

9. The system according to claim 7, wherein the location tracking mechanism is an RFID tag.

10. The system of claim 1, wherein the election and voting machine preparation portion included in the host computer is further configured to upload vote information from the plurality of voting machines after receiving the cast votes at the polling location.

11. The system of claim 1, wherein the election and voting machine preparation portion is configured to prepare or configure individual voting machines with election-specific information.

12. The system of claim 1, wherein the election and voting machine preparation portion is configured to manage all pre-election preparation for the plurality of voting machines prior to deploying the voting machines to a polling location.

13. A voting machine comprising:

a processor;

an input portion coupled with the processor and configured to receive ballots to be scanned;

a network communication device coupled with the processor and configured to receive programming information from at least one external device;

a hardware interlock coupled with the network communication device and configured to disable the network communication device to prevent the voting machine from being accessed via the network during an election period, wherein disabling the network communication device comprises activating an electrical interrupt to prevent network communication with the voting machine while maintaining a physical network connection; and a user interface coupled with the processor and configured to receive cast votes from a voter.

14. The voting machine of claim 13, wherein the voting machine receives all pre-election preparation programming information via the network communication device prior to deployment to a polling location.

15. The system according to claim 13, wherein the voting machine contains a location tracking mechanism.

16. The voting machine according to claim 15, wherein the location tracking mechanism is a barcode.

17. The voting machine according to claim 15, wherein the location tracking mechanism is an RFID tag.

* * * * *